US007438498B2

(12) United States Patent
Despiniadis

(10) Patent No.: US 7,438,498 B2
(45) Date of Patent: Oct. 21, 2008

(54) SECURITY SYSTEM FOR SEWAGE, AQUEDUCT, TELEPHONY AND ENERGY CAPS

(75) Inventor: Dimosthenis Despiniadis, Bogota (CO)

(73) Assignee: Micromotores Limitada, Bogota (CO)

( * ) Notice: Subject to any disclaimer, the term of this patent is extended or adjusted under 35 U.S.C. 154(b) by 0 days.

(21) Appl. No.: 11/811,922

(22) Filed: Jun. 11, 2007

(65) Prior Publication Data

US 2007/0295041 A1 Dec. 27, 2007

(30) Foreign Application Priority Data

Jun. 23, 2006 (CO) ..... 06-061180

(51) Int. Cl.
*B66F 3/00* (2006.01)
*E02D 29/14* (2006.01)

(52) U.S. Cl. ..... 404/25; 52/19; 52/20; 254/131

(58) Field of Classification Search ..... 404/25, 404/26; 52/19, 20; 254/131
See application file for complete search history.

(56) References Cited

U.S. PATENT DOCUMENTS 6,435,763 B1 * 8/2002 Sakane et al. ..... 404/25
6,739,796 B1 * 5/2004 Del Nero et al. ..... 404/25
6,881,007 B2 * 4/2005 Dennis ..... 404/25
7,243,515 B2 * 7/2007 Meyer ..... 70/269
7,293,759 B2 * 11/2007 Beach et al. ..... 254/131

FOREIGN PATENT DOCUMENTS

CH 610281 A5 * 10/1976

* cited by examiner

*Primary Examiner*—Raymond W Addie
(74) *Attorney, Agent, or Firm*—Vangelis Economou; IPHorgan, Ltd.

(57) ABSTRACT

Security System for Sewer, Aqueduct, Telephone and Energy System Manhole Caps or Covers including an electromechanical cover (1), on the surface of which is placed an electromagnetic crane (2) that has a handle (3), and that has an emitting coil (4), a battery (5), an electronic card (6) and a control panel (7); inside a waterproof space at least partially enclosed by the electromechanical cover (1) are placed a receiving coil (8), electronic card (12) and two motors (9) that move a pin (10) that has bellows (11), and that are connected to an electronic card (12). The system operates by the emitting coil (4) transferring electromagnetic energy to the receiving coil (8), and at the same time sending an exclusive binary code. This produces the electricity to operate the electric motors that move the pins (10) that open or close the cover (1); and after the cover (1) is open, a constant magnetic field is produced in a single direction to enable the electromechanical cover (1) to be lifted for the necessary work to be carried out, and to return and position it in place and close it.

9 Claims, 1 Drawing Sheet

SECURITY SYSTEM FOR SEWAGE, AQUEDUCT, TELEPHONY AND ENERGY CAPS

BACKGROUND OF THE INVENTION

1. Technical field

Figure 1:
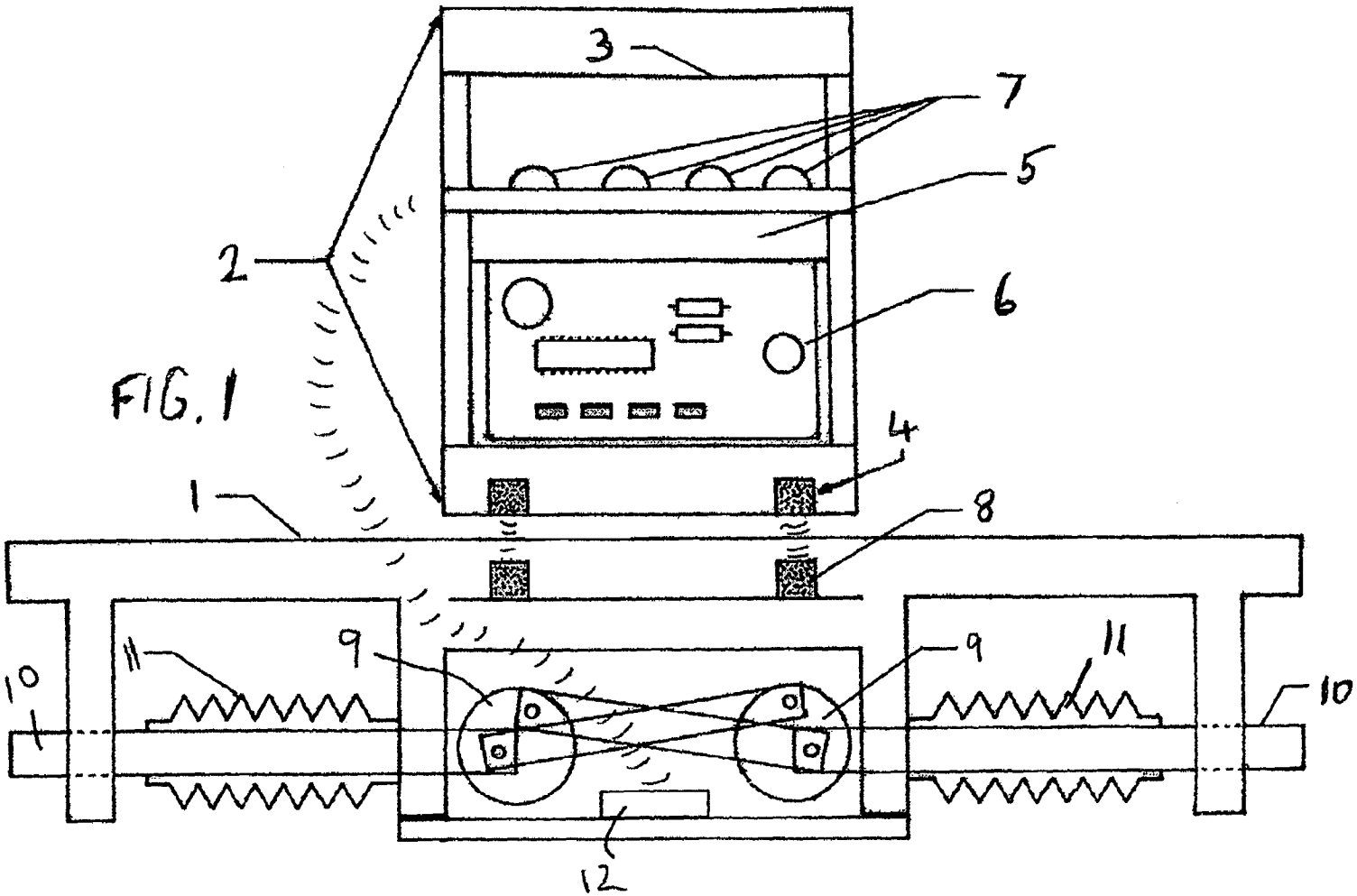

The present application for an Invention Patent to protect a Security System for Sewer, Aqueduct, Telephone and Energy System Manhole Covers or Caps refers to the implementation of a security system that consists of placing an electromagnetic crane on an electromechanical cover, which crane has an emitting coil that transfers electromagnetic energy to a receiving coil that in turn is in the interior of the electromechanical cover, producing enough electricity to operate the electric motors that move mechanical pins that open or close the cover or cap.

2. Background Art

Sewer and similar manhole covers are known today that do not have a security system that allows burglary to be avoided, such as:

Application No. 92-330,043 titled "Method for Making Plastic Manhole Covers for Sewers and the Covers Made with this Method," in the name of Industrias Enterprise Ltda., published in Gazette 370 of Oct. 1, 1992, the application having been declared abandoned by means of Resolution No. 23,621 of Nov. 11, 1999. The application refers to a process for making covers with high mechanical resistance to weight as well as to bending, using plastic material reinforced with fibers, such as isophthalic or orthophthalic resins, characterized by forming, inside appropriate molds, a plurality of superimposed layers of settable polymeric products blended with fibers and/or inorganic reinforcing products and setting catalysts and accelerators, in variable proportions according to the stratum that occupies the layer inside the assembly of superimposed layers, allowing the assembly to set in the respective mold until the assembly develops the qualities that make it highly resistant to mechanical loads and allow it to resist the traffic of heavy vehicles above these covers.

Application No. 97-20,722 titled "A Cover Openable to 180° and the Hinge that Makes it Possible Manufactured in Metal, Plastic or Another Material," belonging to Colombiana De Rejillas Ltda. Colrejillas, published in Gazette 452 of Oct. 15, 1997, granted by means of Resolution No. 16,093 of Aug. 18, 1999, with exploitation license to Diana Carolina Martinez Grisales, by means of Resolution No. 32,860 of Dec. 12, 2000. This cover consists of an external plating collar level with the ground, this collar presenting veins or inlay grooves that reinforce the system to resist heavy loads on the cover, the cover being secured to the external collar by means of a hinge that allows displacement of the cover in two stages, as follows: in the first stage, it moves 90°, to a vertical position above the edge of the cover, and moving from this position to a new position of 180° horizontal to the surface of the floor, in this way not interfering with cleaning and maintenance operations of the sewers that use heavy suction equipment. The hinge used in this invention is made up of a casing, inside which are housed two horizontal turning shafts parallel to each other, the cover being jointed to the first interior horizontal turning shaft located toward the inside of the sewer, to allow the first turning stage of 90°; and the hinge being jointed to the external collar embedded in the floor by means of the second external turning shaft, to allow the second turning stage of the cover of 180°, in relation to the external embedded collar of the cover.

Application No. 01-103,545 titled "Security Fastener with Key for Aqueduct, Sewer, Telephone and Energy System Manhole Covers" in the name of Industrias Estación Ltda., published in Gazette 527 of Apr. 30, 2003, and declared abandoned by means of Resolution No. 31,612 of November 13, 2003. The security fastener is secured to the cover that has a hole, the diameter of which corresponds to the upper part of the shaft of the fastener, which is introduced into this hole and welded. The shaft is fixed to the cover and it allows the turning movement of the fastener after the key has entered from the exterior to the interior through the cylindrical hole that has the shaft of the fastener and it can thus induce the turning movement.

ADVANTAGES OF THE INVENTION

The Patent Invention Application for a Security System for Sewer, Aqueduct, Telephone and Energy System Manhole Covers presents the following advantages with respect to those of the state of the technology; namely:

- The covers offer a security system with the objective that only authorized people can open or close them for purposes of carrying out maintenance and repair inside these repositories.
- The system prevents handling and pilfering of the covers on the part of lawbreakers, which increases the high costs of maintenance of the sites where the covers are placed.

SUMMARY OF THE INVENTION

Wherein in one embodiment the invention is a security system for sewage, aqueduct, telephone and energy system manhole covers comprising an electromechanical cover and an electromagnetic crane that is placed on the surface of the electromechanical cover thereby enabling the crane to open, close, lift or loosen the electromechanical cover, the electromagnetic crane including a handle, an emitting coil, a battery, an electronic card and control panel, and within a waterproof space at least partially enclosed by the electromechanical cover are disposed a receiving coil, an electronic card, and two motors that move a pin that has bellows, that are connected to the electronic card.

In another embodiment, the invention comprises a method of use of such a security system for sewage, aqueduct, telephone and energy system manhole covers, placing the electromagnetic crane on the surface of the electromechanical cover to activate the functions of opening, closing, lifting up or loosening the electromechanical cover through a control panel, transferring electromagnetic energy from an emitting coil to a receiving coil, which produces sufficient electricity to energize the electronic card and the electric motors that operate the mechanical pins to open or close the electromechanical cover, at the same time, the emitting coil, in addition to energizing the electromechanical cover, sends an exclusive binary code for a series of covers assigned to a specific user, and after the electromechanical cover is opened, enabling the electromechanical cover to be lifted, wherein the control of the operations being carried out through the control panel, to produce a constant magnetic field in a single direction that provides the necessary force to enable the electromechanical cover to be lifted for the necessary work, and to return and position it in place and close it.

BRIEF DESCRIPTION OF THE DRAWING FIGURE

FIG. 1. illustrates in a front sectional view the Security System for Sewer, Aqueduct, Telephone and Energy System Manhole Caps according to the present invention.

DETAILED DESCRIPTION OF THE PREFERRED EMBODIMENTS

The present invention embodied in this patent application for a Security System for Sewer, Aqueduct, Telephone and Energy System Manhole Covers, as can be seen in FIG. 1, comprises the implementation of a security system that consists of an electromechanical cover 1 and an electromagnetic crane 2 that is placed on the surface of the cover. The electromagnetic crane 2 consists of a handle 3, an emitting coil 4, a battery 5, an electronic card 6 and a control panel 7 to open, close, lift up and loosen the electromechanical cover 1.

Inside the electromechanical cover 1 within a waterproof space are placed a receiving coil 8 and two electric motors 9 that move a mechanical pin 10 that has bellows 11, that are connected to an electronic card 12.

Operation

The Security System for Sewer, Aqueduct, Telephone and Energy System Manhole Covers that is the object of the present application for an Invention Patent works in the following manner:

An emitting coil 4 transfers electromagnetic energy to a receiving coil 8, which produces sufficient electricity to energize the electronic circuit and the electric motors that operate the mechanical pins 10 that open or close the electromechanical cover 1.

At the same time, for reasons of security, the emitting coil 4 sends a binary code exclusive to each user, and this binary code is interpreted by the electronic card 12, which gives the order to open or close the electromechanical cover 1.

After the electromechanical cover 1 is open, the emitting coil 4 produces a constant magnetic field in a single direction to allow the cover 1 to be lifted for carrying out the necessary work, and returned to be positioned in place and closed.

What is claimed is:

1. A security system for sewage, aqueduct, telephone and energy system manhole cover comprising:

an electromechanical cover, and an electromagnetic crane to be disposed adjacent the electromechanical cover, the electromagnetic crane providing means for enabling the crane to open, close, lift or loosen the electromechanical cover, the enabling means of the electromagnetic crane including a handle, an emitting coil, a battery for providing power to the other elements, an electronic card and control panel, and within a waterproof space at least partially enclosed by the electromechanical cover are disposed a receiving coil, an electronic card for controlling the opening and closing of a mechanical cover locking pin, and two motors that move the mechanical cover locking pin, the mechanical cover locking pin having a bellows and being connected to the electronic card, the battery and the emitting coil being capable of transferring electromagnetic energy from the emitting coil to the receiving coil, and thereby producing sufficient electricity to energize the electronic card and the two electric motors to operate the mechanical pin and thereby to open or lock the electromechanical cover.

2. The security system for sewage, aqueduct, telephone and energy system manhole cover of claim 1 wherein the electromagnetic crane is capable of being placed on the surface of the electromechanical cover to enable the emitting coil to transmit electromagnetic energy to the receiving coil and thereby to enable the crane to lift up the manhole cover by mutual attraction of the constant magnetic field set up by the emitting and receiving coils.

3. A method of operating the security system for sewage, aqueduct, telephone and energy system manhole cover of claim 1, comprising:

a) placing the electromagnetic crane on the surface of the electromechanical cover to activate the functions of opening, closing, lifting up or loosening the electromechanical cover through the control panel;

b) transferring electromagnetic energy from the emitting coil to the receiving coil, thereby producing sufficient electricity to energize the electronic card and the two electric motors that operate the mechanical cover locking pin by withdrawing them to open or by inserting them to close the electromechanical cover;

c) the emitting coil, in addition to energizing the electromechanical cover, simultaneously sending an exclusive binary code enabling operation of a series of covers assigned to a specific user; and d) after the electromechanical cover is opened, enabling the electromechanical cover to be lifted up, wherein the control of the operations being carried out through the control panel, to produce a constant magnetic field in a single direction that provides the necessary force to enable the electromechanical cover to be lifted for the necessary work, and to return and position it in place and close it.

4. A method of operating a security system utilized to secure a sewage, aqueduct, telephone and energy system manhole cover, comprising:

a) providing a two piece manhole cover system, including an electromagnetic crane and an electromechanical cover in a cover base, the electromechanical crane having an emitting coil an electronic card, a battery and a control panel, the electromechanical cover having a receiving coil being electronically connected to an electronic card and to at least one mechanical locking pin being actuated by at least one electric motor, b) placing the electromechanical crane on the surface of the electromechanical cover thereby to activate the functions of opening, closing, lifting up or loosening the electromechanical cover through operation of the control panel;

c) transferring electromagnetic energy powered by the battery from the emitting coil to the receiving coil, thereby producing sufficient electricity to energize the electronic card and the at least one electric motor to operate the mechanical pins by withdrawing them to open or by inserting them to lock the electromechanical cover to the cover base;

d) simultaneously sending an exclusive binary code from the control panel to the electronic card in the electromechanical cover to thereby enable operation of the electromechanical cover to provide a secured authorization for opening the cover.

5. The method of operating a security system according to claim 4 wherein after the electromechanical cover is unlocked by withdrawal of the at least one locking pin, enabling the electromechanical cover to be lifted up, wherein the control of the operations are carried out through the control panel.

6. The method of operating a security system according to claim 5 wherein the coils further produce a constant magnetic field in a single direction that provides the necessary force to enable the electromechanical cover to be lifted up by the electromechanical crane.

7. The method of operating a security system according to claim 5 wherein the movement of the at least one locking pin by the at least one motor is performed within a bellows.

8. The method of operating a security system according to claim 4 wherein the coils further produce a constant magnetic field in a single direction that provides the necessary force to enable the electromechanical cover to be lifted up by the electromechanical crane.

9. The security system according to claim 1 wherein the mechanical cover locking pin is at least partially enclosed within a bellows.

* * * * *